US009221080B2

(12) United States Patent
Soler Esteban et al.

(10) Patent No.: US 9,221,080 B2
(45) Date of Patent: Dec. 29, 2015

(54) METHOD FOR INSPECTION AND SORTING OF PISTACHIOS

(71) Applicant: MULTISCAN TECHNOLOGIES, S.L., Cocentaina (Alicante) (ES)

(72) Inventors: Alvaro Soler Esteban, Cocentaina (ES); Simon Hendrik Van Olmen, Cocentaina (ES)

(73) Assignee: MULTISCAN TECHNOLOGIES, S.L., Cocentaina (Alicante) (ES)

( * ) Notice: Subject to any disclaimer, the term of this patent is extended or adjusted under 35 U.S.C. 154(b) by 118 days.

(21) Appl. No.: 14/133,826

(22) Filed: Dec. 19, 2013

(65) Prior Publication Data

US 2015/0174618 A1 Jun. 25, 2015

(51) Int. Cl.
*B07C 5/10* (2006.01)
*B07C 5/342* (2006.01)

(52) U.S. Cl.
CPC ..... *B07C 5/10* (2013.01); *B07C 5/3422* (2013.01)

(58) Field of Classification Search
CPC ..... B07C 5/34; B07C 5/342; B07C 5/3422; B07C 5/3425; B07C 2501/0081; B07C 5/10
USPC ..... 209/577, 580, 587
See application file for complete search history.

(56) References Cited

U.S. PATENT DOCUMENTS 7,858,893 B1 * 12/2010 Haff et al. ..... 209/577
2014/0142745 A1 * 5/2014 Johnston et al. ..... 700/223

* cited by examiner

*Primary Examiner* — David H Bollinger
(74) *Attorney, Agent, or Firm* — Lucas & Mercanti, LLP

(57) ABSTRACT

Method for the inspection and sorting of pistachios through artificial vision means and by the rotation of the pistachios around their axis; thereby obtaining multiple images of different views of said pistachios. At the inspection stage, an analysis of every image is carried out for detecting the opening edges of the pistachio; the opening edges length and width are measured and the pistachio is sorted according to pre-established values for the length and width of the opening edges. Finally, the pistachios are conveyed through endless means from the inspection unit for collection, and the pistachios sorted by the inspection unit according to pre-established values for the length and width of the opening edges are ejected endlessly.

5 Claims, 1 Drawing Sheet

METHOD FOR INSPECTION AND SORTING OF PISTACHIOS

TECHNICAL FIELD OF THE INVENTION

The present invention refers to the technical field of the inspection and sorting of objects, particularly machines for the inspection and sorting of fruits and small edible products, and more particularly to the transport methods of fruits to an inspection unit and their extraction from the inspection unit, ejecting the fruits which do not comply with certain conditions pre-established by a control system, thereby carrying out a fruit sorting. The object of the present invention refers to a method for inspection and sorting of pistachios by which pistachios are analyzed and sorted on the basis of the length and width of their opening, and those considered closed are ejected according to pre-established values for the length and width of the opening.

BACKGROUND OF THE INVENTION

So far there have been used a great number of devices for the inspection and sorting of small objects, particularly fruits and small edible products, based on the transportation through endless means, such as bands, chains, or conveyor belts, of the fruits to be inspected, to a section in which their inspection is carried out. This inspection, as the case may be, can consist of different analysis, such as size, shape and existing defect analysis, or a sorting and separation of fruits based on size, shape, etc.

These devices for fruit inspection are for example the devices for the automatic sorting of agricultural products, such as fruits, with a roller conveyor, said rollers being tilted to distribute the products to different auxiliary paths and a measuring station.

Other devices are formed by a fruit and vegetable treatment and manipulation train, which also has a pre-selection conveyor which through the rollers derives the products to different stations. Another gauging conveyor rejects the units which are too big or too small.

These machines have the inconvenience that they do not carry out very detailed or precise selections, not detecting small shape variations or visually noticeable defects, In the particular case of pistachios, the objective is to carry out an analysis of pistachios in order to eliminate those that are closed and represent an obstacle or a problem for consumption. At present, these analyses for identifying closed pistachios are carried out by mechanical methods or acoustic means, which, in addition to having a complex operation, also present a large number of errors; thus, these are not efficient in separating closed from opened pistachios.

Specifically, Document GB730434 shows a machine for sorting small fruits, such as peas and pistachios. The machine presents a rotating drum containing a plurality of to needles and a rotating brush on the inside. This technology presents the disadvantage that the drum needles damage the fruit during machine operation. In addition, said technology presents the additional problem that needles may break on occasions and small pieces may get stuck in the fruit, thereby entailing a food safety risk.

It was therefore desirable a system which attained an adequate pistachio inspection and sorting and an efficient separation of closed from opened pistachios, thus avoiding the inconveniences existing in the previous methods in the state of the art.

DESCRIPTION OF THE INVENTION

The present invention solves the existing problems in the state of the art through a method for inspection and sorting of pistachios which comprises the following stages:

First, the pistachios are conveyed through endless means to an inspection unit connected to a control system through transport means which are equipped with rotation means in order to make pistachios rotate around their axis.

Then, the pistachios are inspected while in the endless conveying system through artificial vision means of the inspection unit, and by virtue of the pistachios rotating around their axis, the artificial vision means obtain multiple images of different views of said pistachios.

At the inspection stage, an analysis of every image of the pistachio is carried out for detecting the opening of said pistachio and for measuring the length and width of said opening. With this data, the pistachios are sorted according to the values pre-established by the control system for the length and width of the opening, either opened or closed.

Subsequently, the pistachios are conveyed through endless means from the inspection unit for collection, and the endless rejection of the pistachios sorted by the inspection unit according to previous pre-established values for the length and width of the opening is carried out. In this way, the pistachios sorted as closed are ejected before collection, thereby collecting only those sorted as opened.

Particularly, in order to carry out the length and width measurement of the opening by means of the method object of the present invention, a length and width measurement of the opening is carried out in every pistachio image. Next, all pistachio images obtained are connected according to the lineal speed of the conveying means, the time between every consecutive image taken and in accordance with certain variation tolerances of the pistachio speed with respect to the band speed. Lastly, the highest to value of the lengths and widths of the opening in all images of said pistachio is assigned to the length and width of the opening of each pistachio.

According to the preferred embodiment of the method object of the present invention, at the pistachio inspection stage, a further analysis of the position of the pistachio opening is carried out to determine whether the opening is on the side surface or in the seam of the pistachio. Next, the ejection of the pistachios is also carried out according to this position presented by the opening in relation to the longitudinal axis of the pistachio; that is to say, the pistachios the opening of which is not in the pistachio seam will be ejected.

In addition, preferably, the artificial vision means of the inspection unit take at least one color image and the ejection of the pistachios is carried out according to at least one pre-established color, which implies that the pistachios not having a certain color, or having color spots, will be ejected before collection.

DESCRIPTION OF THE DRAWINGS

The following is a description of a series of drawings which will help understand the invention better relating to an embodiment of said invention which is presented as a non-limiting example thereof.

In these figures reference is made to the following set of elements:

1. pistachios
2. inspection unit
3. transport means
4. pistachio opening
5. pistachio longitudinal axis

DESCRIPTION OF PREFERRED EMBODIMENTS OF THE INVENTION

Figure 1:
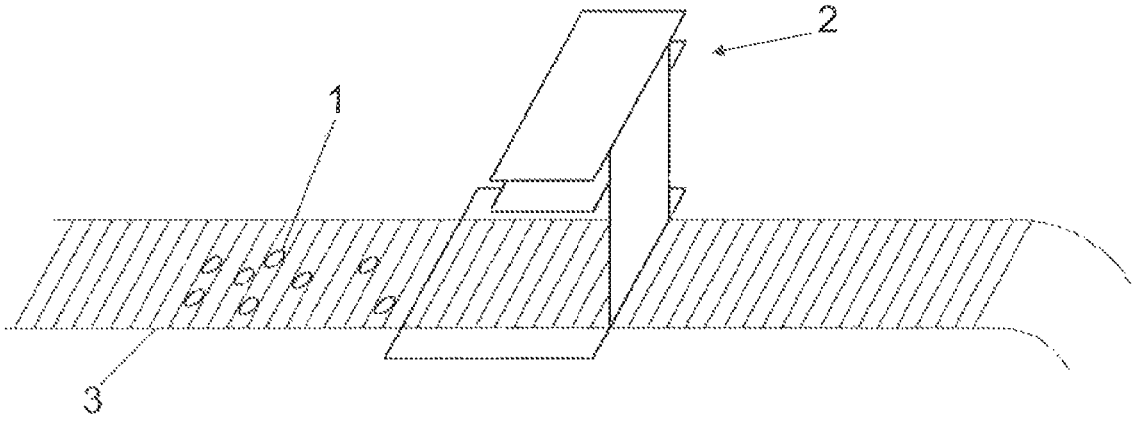
FIG. 1 is a schematic view of the different stages of the method object of the present invention.

The object of the present invention is a method for inspection and sorting of pistachios which, as shown schematically in FIG. 1, comprises the following stages:

In the first stage, pistachios are conveyed through endless means from a loading point to an inspection unit 2 connected to a control system through conveying means 3 which have rotation means for pistachios 1.

Next, pistachios 1 are inspected while in the conveying system through artificial vision means of the inspection unit 2. By virtue of the pistachios 1 rotating around theft longitudinal axis 5, the artificial vision means obtain multiple images of the different views of said pistachios 1.

Figure 2:
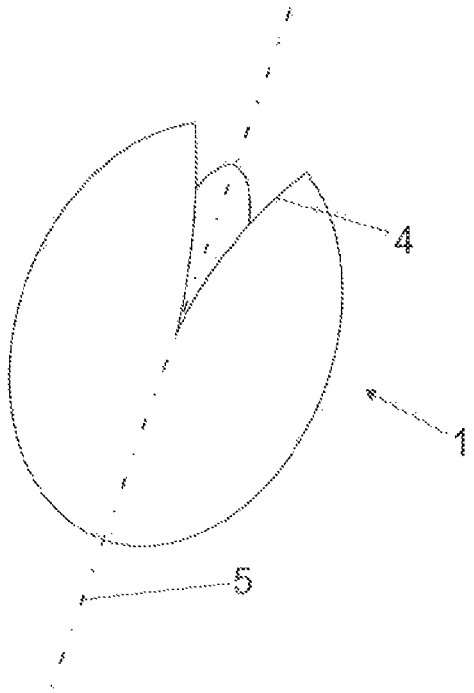
FIG. 2 shows schematically a pistachio with its longitudinal axis and its opening, whose length and width are analyzed under the method object of the present invention.

At the inspection stage, an analysis of every image is carded out for detecting the opening 4 of the pistachio 1 and the length and width of this opening 4 are measured. The pistachio is then sorted according to the values pre-established by the control system for the length and width of said opening 4. If the length and width of the pistachio 1 have lower values than the values pre-established by the control system, the pistachio 1 is sorted as closed and if they have higher values than the pre-established values, the pistachio is sorted as closed. FIG. 2 shows schematically a pistachio with its longitudinal axis 5 and its opening 4 whose length and width are measured.

After inspection and sorting, the pistachios are transported endlessly from the inspection unit to the area where they will be collected and the pistachios 1 sorted by the inspection unit 2 as closed are ejected endlessly, thereby collecting only those pistachios 1 sorted as opened.

Preferably, to measure the length and width of the opening 4 of the pistachio 1, the length and the width of the opening 4 are measured in every image of the pistachio and subsequently, all pistachio images obtained are connected on the basis of various parameters such as the lineal speed of conveying means, the time between every consecutive image taken and certain variation tolerances of the pistachio 1 speed at the axes x-y with respect to the band speed. Lastly, the highest value of the lengths and widths of the opening 4 in all images of said pistachio 1 is assigned to the length and width of the opening 4 of each pistachio 1.

According to a preferred embodiment of the invention, at the inspection stage an additional analysis of the opening 4 position of the pistachio 1 is carried out to prove that the opening is indeed performed in the side area o in the seam of the pistachio 1. To that end, it is verified whether the opening is parallel to the longitudinal axis 5 of the pistachio 1. According to this embodiment, an ejection of the pistachios 1 whose opening is not parallel to the longitudinal axis may be additionally carried out; said pistachios being considered as defective.

Particularly, the artificial vision means of the inspection unit 2 may at least take a color image of the pistachios 1 and an ejection of pistachios 1 according to the color criteria o color spots they present may also take place.

Thus, preferably, under the present method, the pistachios may be ejected according to the pre-established color in a different place where the ejection takes place according to the length and width of the opening 4.

In this way, in the preferred and most advantageous embodiment of the present method, the collection of the pistachios 1 in three different points will be carried out, which allows to have them separate for subsequent actions to be performed in each of them.

First, the pistachios 1 sorted as "good" will be collected in a point; that is to say, those that comply with an opening having a minimum length and width and in addition, having a certain color.

In a further area, the pistachios not complying with the minimum length and width requirements will be ejected and thus considered closed pistachios 1. These pistachios 1 will try to he opened later, which implies additional operations and a higher cost for the treatment of these pistachios 1.

In a different area, the pistachios not complying with the color requirement will be ejected. These pistachios 1 will get colored or will be opened; either will also increase the cost of their treatment.

This is why carrying out an efficient inspection and sorting of the pistachios through the method object of the present invention is important.

Once the invention has been clearly described, it is worth highlighting that the particular embodiments described above can be modified in detail, as long as the main principle and essence of the invention is not altered.

The invention claimed is:

1. A method for inspection and sorting of pistachios, wherein it comprises the stages of:

conveying pistachios through endless means for transporting pistachios to an inspection unit having means for rotating the pistachios;

inspecting the pistachios while in the endless means for transporting through means for artificial vision in the inspection unit wherein the pistachios are rotated around their longitudinal axis, and the means for artificial vision obtains multiple images of different views of said pistachios, the inspecting of the pistachios comprising the sub stages of:

analyzing every pistachio image for detecting an opening of said pistachio, measuring the length and width of the pistachio, sorting the pistachio in accordance with pre-established values for the length and width of the opening of said pistachio;

conveying the inspected pistachios from the inspection unit to a collection unit; and endlessly ejecting the pistachios sorted in the inspection unit in accordance with pre-established values for the length and width of the opening of the pistachios.

2. The method for inspection and sorting of pistachios according to claim 1, wherein the measuring of the length and width of the opening of the pistachio in turn comprises, measuring the length and width of the opening of the pistachio in every pistachio image, connecting all of the pistachio images obtained according to a lineal speed of the means for transporting pistachios, a time between consecutive images taken and variation tolerances of the pistachio speed in respect of a band speed and, assigning a highest value of lengths and widths of the opening in all images of said pistachio to the length and width of the opening of each pistachio.

3. The method for the inspection and sorting of pistachios according to claim 1, wherein in the sub stage of the analysis of the opening of the pistachio, the sub stage comprises further analysis of the opening position of the pistachio by identifying that the opening is on a side area or in a seam of the pistachio parallel to the longitudinal axis of the pistachio, and the ejection of pistachios is carried out according to the position of the opening in relation to the longitudinal axis of the pistachio.

4. The method for the inspection and sorting of pistachios according to claim 1, wherein the means for artificial vision of the inspection unit takes at least one color image of the pistachios, and the ejection of pistachios is carried out according to at least one pre-established color criteria.

5. The method of inspection and sorting of pistachios, according to claim 4, wherein the ejection of the pistachios carried out according to the pre-established color criteria is carried out at a different point than the ejection carried out according to pre-established values for the length and width of the opening.

* * * * *